US009695487B2

(12) United States Patent
Zhang et al.

(10) Patent No.: US 9,695,487 B2
(45) Date of Patent: Jul. 4, 2017

(54) ULTRAHIGH-STRENGTH WEAR-RESISTANT STEEL PLATE AND METHOD OF MANUFACTURING THE SAME

(75) Inventors: Aiwen Zhang, Shanghai (CN); Guodong Wang, Shanghai (CN); Sihai Jiao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 586 days.

(21) Appl. No.: 14/129,106

(22) PCT Filed: May 25, 2012

(86) PCT No.: PCT/CN2012/076058

§ 371 (c)(1), (2), (4) Date: Dec. 23, 2013

(87) PCT Pub. No.: WO2013/075473

PCT Pub. Date: May 30, 2013

(65) Prior Publication Data

US 2014/0124102 A1 May 8, 2014

(30) Foreign Application Priority Data

Nov. 25, 2011 (CN) ..... 2011 1 0383513

(51) Int. Cl.
*C21D 8/02* (2006.01)
*C22C 38/00* (2006.01)
(Continued)

(52) U.S. Cl.
CPC ..... *C21D 8/0263* (2013.01); *C21D 8/0205* (2013.01); *C21D 9/46* (2013.01);
(Continued)

(58) Field of Classification Search
CPC ..... C21D 8/02; C21D 8/0263; C22C 38/02
(Continued)

(56) References Cited

U.S. PATENT DOCUMENTS

2008/0308194 A1 12/2008 Corquillet et al.

FOREIGN PATENT DOCUMENTS

CN 101353763 A 1/2009
CN 101555574 A 10/2009
(Continued)

OTHER PUBLICATIONS

English language translation of JP2009235524. Translation date unknown.*

(Continued)

*Primary Examiner* — Brian Walck
(74) *Attorney, Agent, or Firm* — Kilpatrick Townsend & Stockton LLP

(57) ABSTRACT

The present invention provides a high-strength wear-resistant steel plate with Brinell hardness of ≥HB420, comprising the following chemical compositions (by weight %) C: 0.205-0.25%, Si: 0.20-1.00%, Mn: 1.0-1.5%, P≤0.015%, S≤0.010%, Al: 0.02-0.04%, Ti: 0.01-0.03%, N≤0.006%, Ca≤0.005%, and at least one of Cr≤0.70%, Ni≤0.50%, Mo≤0.30%, other compositions being Ferrum and unavoidable impurities. Also provided is a method of manufacturing the wear-resistant steel plate has remarkable TRIP effect in use, improving substantially its wear resistance, thereby meeting the high demand for wear-resistant steel plates in related industries.

15 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/28*** | (2006.01) |
| ***C22C 38/44*** | (2006.01) |
| ***C22C 38/50*** | (2006.01) |
| ***C21D 9/46*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/28* (2013.01); *C22C 38/44* (2013.01); *C22C 38/50* (2013.01); *C21D 2211/001* (2013.01); *C21D 2211/008* (2013.01)

(58) Field of Classification Search
USPC ..... 148/334, 335, 541, 547; 420/8, 104–112
See application file for complete search history.

(56) References Cited

FOREIGN PATENT DOCUMENTS

| | | | | |
|---|---|---|---|---|
| CN | 101638755 | A | | 2/2010 |
| CN | 101691640 | A | | 4/2010 |
| CN | 102041458 | A | | 5/2011 |
| EP | 2 287 344 | A | | 2/2011 |
| JP | 2009235524 | A | * | 10/2009 |
| JP | 2011-202269 | A | | 10/2011 |

OTHER PUBLICATIONS

International Search Report from PCT/CN2012/076058, dated Sep. 13, 2012 (English translation version).
Xu, Weizong, Microstructural Design of Ultra-high Strength Steels with Ductility Enhancement by Quenching and Partitioning Process. Master's Dissertation of Shanghai Jiao Tong University 2010, p. 22, 35, 36, 42, 53, 54, 61 and 66, XP008172357—Translated English Abstract only is attached with the title "Organization Design Plastic Quenching and Partitioning of Steel Reinforced Super High Strength," 1 page.

* cited by examiner

ULTRAHIGH-STRENGTH WEAR-RESISTANT STEEL PLATE AND METHOD OF MANUFACTURING THE SAME

FIELD OF THE INVENTION

The present invention relates to a high-strength steel plate, in particular to a high-strength wear-resistant steel plate with Brinell hardness of ≥HB420 and a method of manufacturing the same.

BACKGROUND OF THE INVENTION

Wear is one of the main forms of material damage, which may cause surprisingly large economic loss. A great number of equipments used in industries such as metallurgical mine, agricultural machinery and coal industry, fail mostly because of material wear. According to statistics, in industrialized countries, economic loss caused by wear of mechanic equipments and components accounts for about 4% of the gross national production, wherein abrasive wear accounts for 50% of total metal wear. In China, steel consumed by material wear per year is up to above one million tons, in which 60-80 thousand tons of steel plates are consumed per year only in middle grooves of scrape plate conveyor in coal mining.

As an important type of steel, the high-strength low-alloy wear-resistant steel, is applied widely to fields like mining machinery, engineering machinery, agricultural machinery and railway transportation. With the rapid development of China industry, various mechanic equipments become more complicated, larger and lighter, which requires this type of steel used for making these equipments, not only to be of higher hardness and strength, but also good toughness and forming performance. In recent decades, the research and application of high-strength wear-resistant steel develops very fast. This type of steel is developed on basis of high-strength low-alloy weldable steel, with good wear resistance and the service life thereof being many times longer than that of traditional structural steel plate; the manufacturing process thereof is simple, which normally includes quenching and tempering directly after rolling, or controlled rolling and controlled cooling to strengthen.

Now, in the field of high-strength wear-resistant steel, there have been many related patents and patent applications in China and other countries. With regard to ultrahigh-strength low-carbon (0.205-0.25%) wear-resistant steel, it is necessary to add Nb, V or B in patents JP1255622A, JP2002020837A, CN101469390, CN101186960A and CN101775545A, and many expensive alloy elements in patents JP2002020837A, JP2002194499A, CN1208776A, CN101469390A, CN101186960A and CN101775545A. As to the processes, in most of these patents, quenching (DQ or offline heating and quenching)+offline tempering is adopted, whereby the low-temperature impact value at −40° C. of the finished steel plate is not high, that is, mainly between 17-50 J, which cannot meet the demand of users.

Hardox400 wear-resistant steel plate (4-32 mm) (C≤0.18, Si≤0.70, Mn≤1.6, P≤0.025, S≤0.010, Ni≤0.25, Cr≤1.0, Mo≤0.25, B≤0.004) produced by Sweden SSAB, contains low content of expensive alloy elements, with the hardness of between HBW370-430, and good wear resistance. The steel plate of 20 mm thick has typically a yield strength of 1000 MPa, $A_{50}$ of 16%, and longitudinal $A_{kv}$ at −40° C. of 45J. Although its hardness, strength and wear resistance is high, both the standard and physical impact values thereof are not high, and it has no TRIP (self hardening) effect in use.

Currently, it is necessary to provide a high-strength wear-resistant medium steel plate with TRIP effect.

SUMMARY OF THE INVENTION

The objective of the present invention is to provide a high-strength wear-resistant medium steel plate with Brinell hardness of ≥HB420, particularly to provide such a steel plate having a thickness of 6-25 mm.

To achieve the aforementioned objective, the medium steel plate of the present invention contains the following chemical compositions, by weight, C: 0.205-0.25%, Si: 0.20-1.00%, Mn: 1.0-1.5%, P≤0.015%, S≤0.010%, Al: 0.02-0.04%, Ti: 0.01-0.03%, N≤0.006%, Ca≤0.005%, and at least one of Cr≤0.70%, Ni≤0.50%, Mo≤0.30%, other compositions being Ferrum and unavoidable impurities.

The structure of the steel plate consists of martensite and residual austenite, wherein, the residual austenite accounts for 5-10%.

Another objective of the present invention is to provide a method of manufacturing the high-strength wear-resistant steel plate with Brinell hardness of ≥HB420, which is comprised of:

(1) after vacuum degassing treatment, continuous-casting or die-casting molten steel, and if the molten steel is die-casted, blooming it into a billet;

(2) heating the continuous casting slab or billet at temperature of 1150-1250° C., then one-pass or multi-pass rolling it in austenite recrystallization zone, with the total reduction ratio being no less than 70% and the rolling finishing temperature being no less than 860° C.;

(3) water-cooling rapidly the rolled steel plate at speed of Vmin~50° C./s to the temperature range Ms-145~Ms-185° C., then air-cooling it to ambient temperature, wherein hardening index P is calculated according to the expression (i) P=2.7C+0.4Si+Mn+0.45Ni+0.8Cr+0.45Cu+2Mo, the critical cooling speed Vmin for obtaining martensite is calculated according to the expression (ii) lgVmin=2.94−0.75P, and the starting temperature of forming martensite Ms is calculated according to the expression (iii) Ms=561-474C-33Mn-17Cr-17Ni-21Mo.

The inventor finds that in structure of wear-resistant steel plate, when the content of residual austenite accounts for a certain value (for example ≥5%), the steel plate may exhibit apparent TRIP effect, which may improve substantially the hardness and wear-resistance of the surface. TRIP is the abbreviation for "TRansformation Induced by Plasticity" and the TRIP effect means that when a steel plate is punched or subjected to impact load, the residual austenite therein may phase-changed into martensite, causing the deformed part to harden rapidly so as to resist further deformation, and simultaneously transferring the deformed part to the adjacent position, whereby obtaining very high elongation, i.e. plasticity. As for wear-resistant steel plate, when it is impacted or deformed frictionally by other materials, residual austenite in the deformed part is converted into martensite, with consuming the energy brought by material impact or frictional deformation, which reduces the abrasion loss and improves the wear resistance thereof. Structures of conventional wear-resistant steel plate are mainly martensite or bainite and a few residual austenites, and due to that the amount of residual austenite is small, TRIP effect may not occur, for example, in Hardox400 wear-resistant steel plate produced by Sweden SSAB.

The present invention adopts suitable carbon content, low-cost alloy elements Si and Mn, and a few expensive alloy elements Cr, Ni and Mo, without Cu, Nb, V, B and the like, which reduces greatly the alloy cost of steel plate, i.e. having remarkable advantage on alloy cost. As to rolling, it is unnecessary to controlled roll the non-recrystallization zone, reducing the loads of rolling mills, and it is just needed to water-cool rapidly the rolled steel plate at speed of Vmin~50° C./s to the temperature range Ms-145~Ms-185° C., then to air-cool it to ambient temperature. The structure of steel plate with a thickness of 6-25 mm are martensite and residual austenite (5-10%), which has a hardness of ≥HB420, a yield strength of ≥1000 MPa, an elongation of ≥18%, $A_{kv}$ at −40° C. of ≥27J and good cool bending property, especially, has remarkable TRIP effect in use, improving substantially the surface hardness and wear resistance, thereby meeting the high demand for wear-resistant steel plates in related industries.

DETAILED DESCRIPTION OF THE INVENTION

Figure 1:
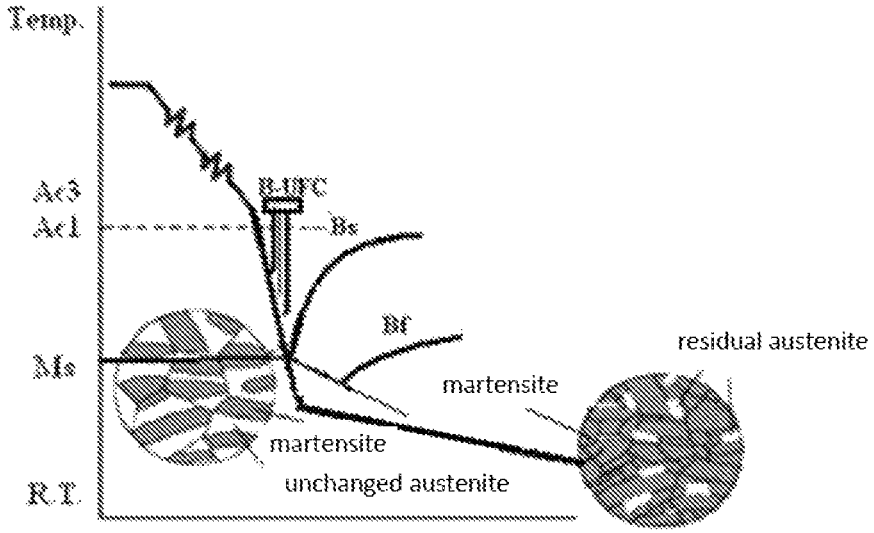
FIG. 1 is the schematic view of the process flow of the finished martensite and residual austenite obtained by online rapid cooling and air cooling according to the present invention, wherein Temp indicates temperature; R.T indicates ambient temperature; Bs indicates the starting temperature of bainite conversion; Bf indicates the finishing temperature of bainite conversion; Ms indicates the starting temperature of martensite conversion; and B-UTC indicates ultra-fast cooling.

Hereinafter, the present invention will be described in details with reference to the embodiments.

In the present invention, unless otherwise specified, the content herein always indicates the percentage by weight.

To achieve the objective of providing a high-strength wear-resistant medium steel plate with Brinell hardness of ≥HB420, particularly to provide a medium steel plate having a thickness of 6-25 mm, the present invention chooses the basic chemical components and controls the content thereof as follows, and the reason is described as well.

Carbon: carbon is the key element to guarantee the strength of steel plate. To obtain steel plates constituted mainly of martensite and residual austenite, carbon is the most important element, which can significantly improve hardenability of the steel plates. Owing to high solubility of carbon in austenite, it can keep high stability of austenite, and lower Ms point of the steel, which is good for obtaining a certain amount of residual austenites. Simultaneously, the increment of carbon may cause the strength and hardness to improve and plasticity to decline, so if the steel plate needs high strength and toughness and residual austenite of about 5-10%, the carbon content should not be too low. Considering comprehensively the factors above, for the hardness of HB420 in the present invention, carbon content of 0.205-0.25% is suitable. Preferably, the carbon content is 0.205-0.245%.

Silicon: addition of silicon in steel can improve the purity and deoxygenation of steel. Silicon in steel contributes to solid solution strengthening, and owing to high solubility of silicon in austenite, the increment of silicon is good for promoting the strength and hardness of steel and improving the stability of austenite, especially, when the steel plate, after online direct quenched and reheated online to bainite temperature range, is tempered, it can promote carbides in martensite to precipitate and carbon to disperse into residual austenite, such that the carbon content in residual austenite increases, and the austenite is stabilized without conversion until ambient temperature and that the steel plate at ambient temperature obtains compounded structure of tempered martensite and residual austenite, which in use has TRIP effect, thereby improving the wear resistance. But excessive silicon may cause the steel toughness to decline and when the steel plate with excessive silicon is heated, the oxide skin thereof may become highly viscous, and it is difficult to descale after the steel plate exiting from furnace, thereby resulting in a lot of red oxide skins on the rolled steel plate, i.e. the surface quality is bad; besides, the excessive silicon may also be harmful to the weldability of steel plate. In consideration of all the factors above, the content of silicon in the present invention is 0.20-1.00%. Preferably, the silicon content is 0.20-0.99%.

Manganese: manganese is used for stabilizing austenite structures, and this capacity is second only to the alloy element nickel. It is an inexpensive element for stabilizing austenite structures and strengthening alloying. At the same time, manganese can improve the steel hardenability, and decrease the critical cooling rate of forming martensite. However, manganese has a high segregation tendency, so its content should not be very high, generally, no more than 2.0% in low-carbon microalloyed steel. The amount of manganese added depends mostly on the strength and hardness level of the steel. The manganese content in the present invention should be controlled within 1.0-1.5%. Furthermore, manganese together with aluminum in steel contributes to deoxygenating. Preferably, the manganese content is 1.11-1.45%.

Sulphur and phosphorus: in steel, sulphur, manganese and the like are compounded into a plastic inclusion, manganese sulfide, which is especially, harmful to the transverse ductility and toughness thereof, thus the sulphur content should be as low as possible. The element, phosphorus in steel, is also one of the harmful elements, which seriously impairs the ductility and toughness of steel plates. In the present invention, both sulphur and phosphorus are unavoidable impurity elements that should be as few as possible. In view of the actual steelmaking conditions, the present invention requires that P is ≤0.015%, S is ≤0.010%. Preferably, the content of P is ≤0.009%, and the content of S is ≤0.004%.

Aluminum: in the present invention, aluminum acts as a strong deoxidization element. To ensure the oxygen content as low as possible, the aluminum content should be controlled within 0.02-0.04%. After deoxidization, the remaining aluminum is combined with nitrogen in steel to form AlN precipitation which can improve the strength and during heat treatment, refine the austenitic grains therein. Preferably, the aluminum content is 0.021-0.039%.

Titanium: titanium is a strong carbide-forming element. The addition of trace Ti in steel is good for stabilizing N, and TiN formed can also make austenitic grains of billets, during being heated, not coarsening too much, whereas refining the original austenitic grains. In steel, titanium may be compounded with carbon and sulphur respectively to form TiC, TiS, $Ti_4C_2S_2$ and the like, which exist in the forms of inclusion and second-phase particles. Now, trace titanium treatment has been a conventional process for most high-strength low-carbon steels. In the present invention, the titanium content is controlled within 0.01-0.03%. Preferably, the titanium content is 0.013-0.022%.

Chromium: chromium promotes hardenability and tempering resistance of steel. Chromium exhibits good solubility in austenite and can stabilize the austenite. After quenching, much of it dissolves in martensite and subsequently in tempering process, precipitates carbides such as $Cr_{23}C_7$, $Cr_7C_3$, which improves the strength and hardness of steel. For keeping the strength level of steel, chromium may replace manganese partly and weaken the segregation tendency thereof. Accordingly, in the present invention, no more than 0.70% of chromium may be added. Preferably, the chromium content is 0.35-0.65%.

Nickel: nickel is the element used for stabilizing the austenite, with no remarkable effect on improving strength. Addition of nickel in steel, particularly in quenched and tempered steel, can promote substantially toughness, particularly low-temperature toughness thereof, but it is an expensive alloy element, therefore the present invention may add no more than 0.50% of nickel. Preferably, the nickel content is 0.16-0.40%.

Molybdenum: molybdenum can significantly refine grains, and improve the strength and toughness of steel. It reduces tempering brittleness of steel while precipitating very fine carbides during tempering, which can remarkably strengthen the matrix thereof. Because molybdenum is a kind of strategic alloy element which is very expensive, in the present invention, no more than 0.30% of molybdenum is added. Preferably, the molybdenum content is 0.18-0.24%.

Calcium: the addition of calcium in steel is, mainly, to change the form of the sulfides, thereby improving the transverse performance of the steel. For steel with very low sulfur content, calcium treatment may be not necessary. The content of calcium is less than or equal to 0.005%. Preferably, the calcium content is 0.001-0.003%.

Nitrogen: the present invention does not contain microalloyed elements Nb and V, and the strengthening forms are phase-change strengthening and tempered carbide precipitation strengthening. Nitrogen of less than or equal to 60 ppm can stabilize 0.01-0.03% titanium and form TiN, which can ensure that when heating a blank, the austenite grains therein do not coarsen too much. In the present invention, the nitrogen content is ≤0.006%. Preferably, the nitrogen content is 0.0033-0.004%.

In the present invention, addition of elements like carbon, nickel which can improve the stability of austenite, can increase the content of residual austenite in quenched steel, which is good for the steel to obtain TRIP effect. Besides, the process of controlling final cooling temperature and no tempering may also increase the residual austenite content.

The following processes have effects on products of the present invention:

- bessemerizing and vacuum treatment: its aim is to guarantee that molten steel contains basic components, to remove harmful gases such as oxygen, hydrogen therein, to add necessary alloy elements such as manganese, titanium, and to adjust them.
- continuous casting or die casting: its aim is to ensure that the blank has homogeneous inner components and good surface quality, wherein static ingots formed by die casting need to be rolled into billets;
- heating and rolling: heating the continuous casting slab or billet at temperature of 1150-1250° C. to, on one hand, obtain uniform austenite structure, and on the other hand, dissolve partly the compounds of alloy elements like titanium, chromium. One-pass or more-than-three-pass rolling it in austenite recrystallization temperature range into steel plate, with the total reduction ratio being no less than 70%, and the rolling finishing temperature being no less than 860° C. (preferably, 860-890° C.);
- rapidly cooling: according to the expression (i), calculating the hardening index P and according to the expression (ii), calculating the critical cooling speed Vmin for obtaining martensite, then according to the expression (iii), calculating the starting temperature of forming martensite Ms. Water-cooling rapidly the rolled steel plate at speed of Vmin~50° C./s (preferably 16-50° C./s) to the temperature range Ms-145~Ms-185° C., then air-cooling it to ambient temperature. During the rapid cooling, most alloy elements are dissolved into martensite, and due to the control of the final cooling temperature, the structure keeps a certain amount of residual austenite, for example 5-10%. The residual austenite guarantees steel plate in use to obtain TRIP effect.

Figure 2:
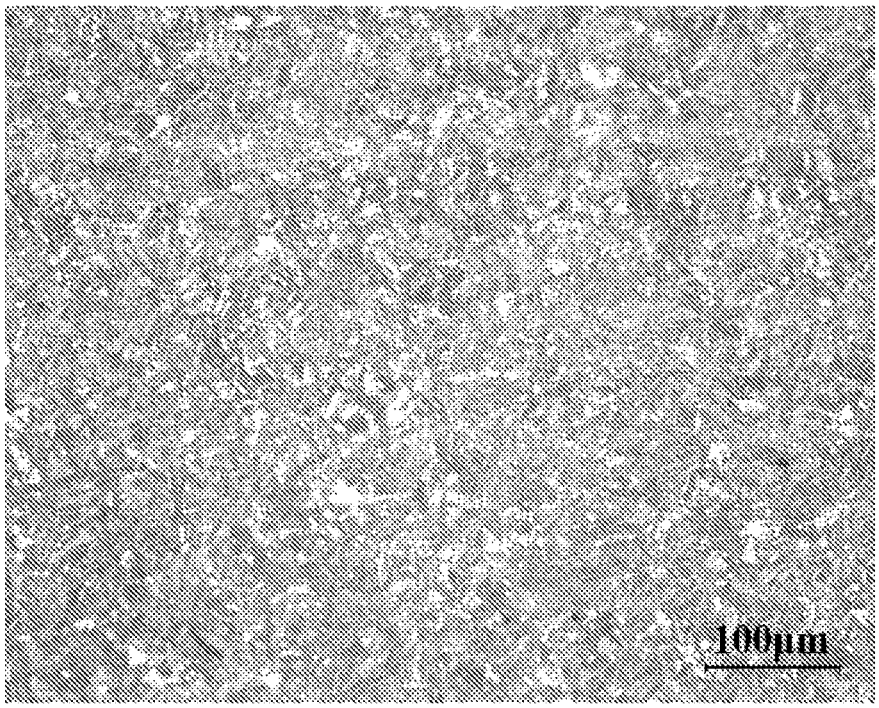
FIG. 2 is a typical metallographic structure photo of the ultrahigh-strength steel plate with a thickness of 15 mm of the embodiment 3 according to the present invention.
Figure 3:
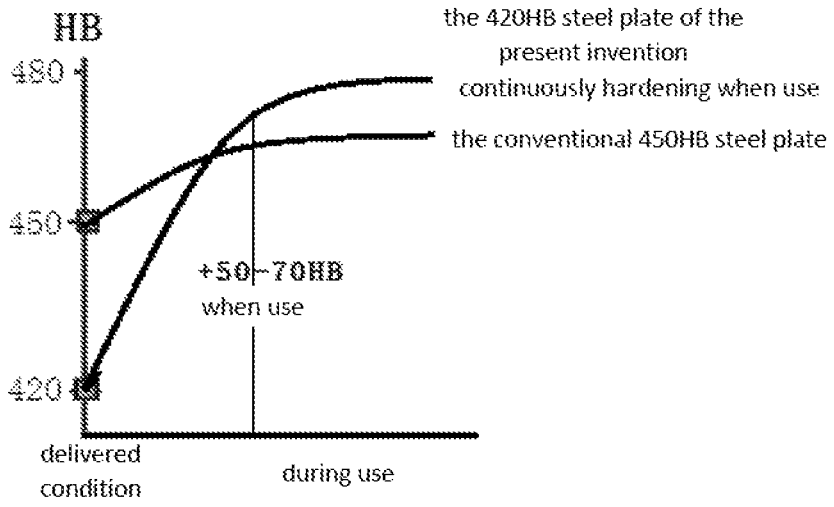
FIG. 3 is the schematic view of comparison on hardness changing tendency between the present invention and conventional steel when delivered and used.

In the present invention, by using the appropriate component design, controlled rolling, rapid cooling, controlling final cooling temperature process, the steel plate is fine-grain, phase-change, and precipitation strengthened. FIG. 1 is the schematic view of process control of steel plate structure. The finished structure of the steel plate presents martensite and residual austenite, for example, FIG. 2 shows a typical structure of steel plate of 15 mm thick. The finished steel plate with a thickness of 6-25 mm has a hardness of ≥HB420, a yield strength of ≥1000 MPa, an elongation of ≥18%, $A_{kv}$ at −40° C. of ≥27J and good cool bending property, especially, has remarkable TRIP effect in use, improving substantially its surface strength, hardness and wear resistance, thereby meeting the high demand for wear-resistant steel plates in related industries. FIG. 3 is the schematic view of the surface hardening effect of the steel plate in use.

The high-strength wear-resistant medium plate made by using the aforementioned component design and process controlling method, is employed for producing members in various industries. Owing to that the steel plate has remarkable TRIP effect, it features low hardness when delivered, which is convenient for users to machine to shape, and when in use, its hardness can be substantially improved, with its wear resistance improving greatly.

EMBODIMENTS

Hereinafter, the present invention will be described in details with reference to embodiments. These embodiments are only the optimal modes of the present invention but not to limit the scope thereof. Table 1 shows the chemical components, carbon equivalents and minimum cooling rate of steel plates of the embodiments, Table 2 shows the process parameters thereof, and Table 3 shows properties of the finished steel plates obtained by the embodiments.

Embodiment 1

Molten steel smelt in accordance with the matching ratio of table 1, after vacuum degassing, is continuous-casted or die-casted, obtaining a slab of 80 mm thick. The slab is heated at 1200° C., and multi-pass rolled in the austenite recrystallization temperature range into steel plate with a thickness of 6 mm, wherein the total reduction rate is 94%, the rolling finishing temperature is 890° C.; then it is cooled to 250° C. at speed of 50° C./s, after which the steel plate is air-cooled to ambient temperature.

The process flow of embodiments 2-6 are similar to that of embodiment 1, and the detailed components and process parameters thereof are shown in Table 1 and Table 2. The properties of the finished steel plate in the embodiments are shown in Table 3.

with the result shown in Table 3. The metallographic structures of the steel plate of all the embodiments are martensite and 5-10% residual austenite.

FIG. 2 is a typical metallographic structure photo of the ultrahigh-strength steel plate with a thickness of 15 mm of the embodiment 3 in the present invention. Similar metallographic structures to that in FIG. 2 can be gained from other embodiments.

TABLE 1

Chemical Components, Ceq (wt %) and Critical Cooling Rate $V_{min}$ (° C./s) for Obtaining Martensite in Embodiments 1-6 of The Present Invention

| Embodiments | C | Si | Mn | P | S | Al | Ni | Cr | Mo | Ti | Ca | N | Ceq* | $V_{min}$ |
|---|---|---|---|---|---|---|---|---|---|---|---|---|---|---|
| 1 | 0.205 | 0.35 | 1.35 | 0.007 | 0.003 | 0.025 | 0.20 | 0.45 | 0.18 | 0.015 | | 0.0038 | 0.57 | 6 |
| 2 | 0.214 | 0.45 | 1.45 | 0.008 | 0.003 | 0.021 | 0.16 | 0.35 | 0.22 | 0.022 | | 0.004 | 0.58 | 5 |
| 3 | 0.228 | 0.20 | 1.11 | 0.007 | 0.003 | 0.039 | 0.23 | 0.55 | 0.21 | 0.015 | | 0.0035 | 0.58 | 7 |
| 4 | 0.20 | 0.99 | 1.38 | 0.007 | 0.003 | 0.026 | 0.20 | 0.47 | 0.20 | 0.018 | | 0.0036 | 0.58 | 5 |
| 5 | 0.232 | 0.25 | 1.20 | 0.008 | 0.003 | 0.036 | 0.38 | 0.60 | 0.19 | 0.014 | 0.002 | 0.0033 | 0.62 | 5 |
| 6 | 0.245 | 0.30 | 1.19 | 0.008 | 0.003 | 0.029 | 0.40 | 0.65 | 0.24 | 0.013 | 0.002 | 0.0039 | 0.64 | 3 |

*Ceq = C + Mn/6 + (Cr + Mo + V)/5 + (Ni + Cu)/14

TABLE 2

Heating, Rolling, and Cooling-Related Process Parameters and Steel Plate Thickness in Embodiments 1-6 of The Present Invention

| Embodiments | Heating Temperature/° C. | Rolling finishing Temperature/° C. | Reduction Rate/% | Cooling Speed/° C./s | Final Cooling Temperature/° C. | Plate Thickness/mm |
|---|---|---|---|---|---|---|
| 1 | 1150 | 890 | 94 | 50 | 250 | 6 |
| 2 | 1150 | 870 | 88 | 36 | 255 | 10 |
| 3 | 1250 | 860 | 80 | 25 | 280 | 15 |
| 4 | 1150 | 860 | 80 | 22 | 270 | 15 |
| 5 | 1200 | 860 | 75 | 22 | 255 | 20 |
| 6 | 1150 | 860 | 70 | 18 | 235 | 25 |

Test 1: Mechanical Properties of Steel Plate

According to GB/T228-2002 Metallic materials—Tensile testing at ambient temperature and GB 2106-1980 Metallic materials—Charpy v-notch impact test, mechanical properties, that is, the yield strength, tensile strength, elongation and impact toughness at −40° C. and the like are measured, with the result shown in Table 3.

Test 2: Hardness

According to GB/T 231.1-2009 test, Brinell hardness of embodiments 1-6 in the present invention is measured, with the result shown in Table 3.

Test 4: Transverse Cool Bending Properties

According to GB/T 232-2010 Metallic materials—Bend test, the steel plates in embodiments 1-6 are cold-bent transversely for d=2a, 180°, with the result shown in Table 3.

Test 5: Welding Performance Test

According to GB4675.1-84 Inclined Y-notch welding crack test, the welding performance of the embodiment 6 in the present invention is assessed, with the result shown in Table 4. It can be seen from Table 4 that the steel plate of the embodiment 6 does not crack after being welded under the condition of preheating temperate 75° C., which indicates that the steel plate of the present invention is of excellent welding performance.

TABLE 3

Mechanical Properties of The Steel Plates of The Present Invention

| Embodiments | Hardness/HB | Yield Strength/MPa | Tensile Strength/MPa | Elongation $A_{50}$/% | −40° C. $A_{kv}$ Impact Toughness/J | Transverse Cool Bending d = 2a, 180° | Structures |
|---|---|---|---|---|---|---|---|
| 1 | 420 | 1035 | 1345 | 19.3 | 31 | PASS | M + $A_R$ |
| 2 | 425 | 1045 | 1360 | 19 | 42 | PASS | M + $A_R$ |
| 3 | 430 | 1055 | 1385 | 20 | 55 | PASS | M + $A_R$ |
| 4 | 440 | 1065 | 1410 | 20 | 63 | PASS | M + $A_R$ |
| 5 | 455 | 1110 | 1455 | 19 | 58 | PASS | M + $A_R$ |
| 6 | 460 | 1150 | 1480 | 18.5 | 61 | PASS | M + $A_R$ |

M: martensite $A_R$: residual austenite, of 5-10%

Test 3:

The steel metallographic structures of the embodiments in the present invention is measured by optical microscope,

TABLE 4

Result of Small Steel Grinding Test of Embodiment 6 in The Present Invention

| No. | Surface Crack Rate/% | Root Crack Rate/% | Section Crack Rate/% | Preheating Temperature | Ambient Temperature | Relative Humidity |
|---|---|---|---|---|---|---|
| 1 | 0 | 0 | 0 | 75° C. | 30° C. | 60% |
| 2 | 0 | 0 | 0 | | | |
| 3 | 0 | 0 | 0 | | | |
| 4 | 0 | 0 | 0 | | | |
| 5 | 0 | 0 | 0 | | | |

In other embodiments, same results can be obtained, that is, the surface crack rate (%), the root crack rate (%), and the section crack rate (%) are all 0.

Test 6: Wear-Resistance Test

Wear-resistance test is conducted in MG2000 grain-abrasion testing machine. A cylindrical sample with a diameter of 5.0 mm and length of 20 mm is placed on a frictional disk and rotates circularly. On the frictional disk, an abrasive paper of 10# is stuck, and a pin under a load pressure of 30N, is tested thereon for friction consumption. The sample has a relative speed of 0.8 m/s, a friction distance 200 mm, a test temperature T=25° C. A TG328A photoelectric analytical balance is employed for weighting, and the loss on weight of the pin before and after the test, indicates the wear loss.

Comparative tests on wear-resistance between the embodiment 2 of the present invention and the wear-resistant steel HARDOX400 produced by Sweden SSAB, are conducted. Due to that there is a difference on hardness between the embodiment 2 and the comparative material, taking the embodiment 2 as a reference, the hardness and wear loss of the HARDOX400 wear-resistant steel plate (with hardness of HB405) is converted, and indicated by absolute wear loss, hardness difference and wear loss difference, which are shown in Table 5. It is known from Table 5 that comparing to that produced by Sweden SSAB, the ultrahigh-strength wear-resistant steel plate of the present invention has a large extent of improvement (about 30%) on wear resistance.

TABLE 5

Comparative Results on Wear Resistance between The Embodiment 2 and The Wear-Resistant Steel HARDOX400

| Steel Grade (Hardness) | Testing Temperature | Conditions of Wear Test | Wear Loss (mg) | Hardness Difference/% | Wear Loss Difference/% |
|---|---|---|---|---|---|
| Embodiment 2 (HB425) | Ambient Temperature 25° C. | 100# Abrasive Paper, 30N Load, Rotation Speed 0.8 m/s, Friction Distance 200 m | 24 | 0 | 0 |
| HARDOX400 (HB405) | | | 34 | −5 | +42 |

In other embodiments, the wear resistance of the steel plate acquired is also better than that of HARDOX400 steel plate (its hardness is HB400) produced by Sweden SSAB.

It can be seen from the embodiments above, by using the aforementioned appropriate component design and process parameters, the tempered steel plate with a thickness of 6-25 mm has a hardness of ≥HB420, a yield strength of ≥1000 MPa, an elongation of $A_{50}$≥18%, $A_{kv}$ at −40° C. of ≥27J and good cool bending property, and the structures thereof present martensite and residual austenite (5-10%). It is of good welding performance and wear resistance which, comparing to that the imported HB400 wear-resistant steel plate, improves by about 30%. Especially, the steel plate features low hardness when delivered, which is convenient for users to machine to shape, and when in use, owing to that the steel plate has remarkable TRIP effect, its surface strength, hardness and its wear resistance can be substantially improved, thereby meeting the high demand for the wear-resistant steel plate in related industries.

The invention claimed is:

1. A wear-resistant steel plate, comprising the following chemical compositions, by weight percentage, C: 0.205-0.25%, Si: 0.20-1.00%, Mn: 1.0-1.5%, P≤0.015%, S≤0.010%, Al: 0.02-0.04%, Ti: 0.01-0.03%, N≤0.006%, Ca≤0.005%, and at least one of Cr, Ni and Mo with Cr≤0.70%, Ni≤0.50%, and Mo≤0.30%, and the balance being Ferrum and unavoidable impurities; wherein the wear-resistant steel plate has a Brinell hardness of ≥420 HB and has a structure characterized as tempered martensite and 5-10% residual austenites, and wherein the wear-resistant steel plate does not contain B.

2. The wear-resistant steel plate according to claim 1, characterized in that the carbon equivalent Ceq is 0.57-0.64.

3. The wear-resistant steel plate according to claim 1, characterized in that C is 0.205-0.245% by weight.

4. The wear-resistant steel plate according to claim 1, characterized in that Si is 0.20-0.99% by weight.

5. The wear-resistant steel plate according to claim 1, characterized in that Mn is 1.11-1.45% by weight.

6. The wear-resistant steel plate according to claim 1, characterized in that P is ≤0.009% by weight.

7. The wear-resistant steel plate according to claim 1, characterized in that S is ≤0.004% by weight.

8. The wear-resistant steel plate according to claim 1, characterized in that Al is 0.021-0.039% by weight.

9. The wear-resistant steel plate according to claim 1, characterized in that Ti is 0.013-0.022% by weight.

10. The wear-resistant steel plate according to claim 1, characterized in that N is 0.0033-0.004% by weight.

11. The wear-resistant steel plate according to claim 1, characterized in that Ca is 0.001-0.003% by weight.

12. The wear-resistant steel plate according to claim 1, characterized in that Cr is 0.35-0.65% by weight.

13. The wear-resistant steel plate according to claim 1, characterized in that Ni is 0.16-0.40% by weight.

14. The wear-resistant steel plate according to claim 1, characterized in that Mo is 0.18-0.24% by weight.

15. The wear-resistant steel plate according to claim 1, characterized in that the thickness thereof is 6-25 mm.

* * * * *